US008602276B2

(12) United States Patent
Tyybakinoja

(10) Patent No.: US 8,602,276 B2
(45) Date of Patent: Dec. 10, 2013

(54) HOLSTER FOR KEEPING A PISTOL

(75) Inventor: Jarno Tyybakinoja, Hyvinkaa (FI)

(73) Assignee: Holster Tech Finland Oy, Helsinki (FI)

( * ) Notice: Subject to any disclaimer, the term of this patent is extended or adjusted under 35 U.S.C. 154(b) by 198 days.

(21) Appl. No.: 13/058,030

(22) PCT Filed: Sep. 10, 2009

(86) PCT No.: PCT/FI2009/050724

§ 371 (c)(1),
(2), (4) Date: Feb. 8, 2011

(87) PCT Pub. No.: WO2010/029219

PCT Pub. Date: Mar. 18, 2010

(65) Prior Publication Data

US 2011/0163138 A1 Jul. 7, 2011

(30) Foreign Application Priority Data

Sep. 12, 2008 (FI) ..... 20085862

(51) Int. Cl.
*F41C 33/02* (2006.01)
*F41C 33/00* (2006.01)

(52) U.S. Cl.
USPC ..... 224/244; 224/193; 224/198; 224/243; 224/912

(58) Field of Classification Search
USPC ..... 224/243, 244, 192, 193, 198, 238, 911, 224/912; D3/222
See application file for complete search history.

(56) References Cited

U.S. PATENT DOCUMENTS

| | | | | |
|---|---|---|---|---|
| 2,455,635 | A * | 12/1948 | Witte | 224/241 |
| 4,377,249 | A * | 3/1983 | Bockoven | 224/163 |
| D273,604 | S * | 4/1984 | McMahan | D3/222 |
| 5,573,157 | A * | 11/1996 | Mauriello et al. | 224/244 |
| 2001/0048009 | A1* | 12/2001 | Vor Keller et al. | 224/244 |
| 2002/0011504 | A1* | 1/2002 | Cerato | 224/243 |
| 2002/0100780 | A1* | 8/2002 | Rogers et al. | 224/243 |
| 2003/0042279 | A1* | 3/2003 | Locklear, III | 224/244 |
| 2003/0226866 | A1* | 12/2003 | Har-Shen | 224/244 |
| 2004/0050887 | A1* | 3/2004 | Spielberger | 224/244 |
| 2006/0156525 | A1* | 7/2006 | Jenkins et al. | 29/407.1 |
| 2008/0142556 | A1* | 6/2008 | Fan | 224/243 |
| 2009/0224014 | A1* | 9/2009 | Kumuchian | 224/244 |
| 2011/0011904 | A1* | 1/2011 | Schultz et al. | 224/244 |

* cited by examiner

*Primary Examiner* — Nathan J Newhouse
*Assistant Examiner* — Phillip Schmidt
(74) *Attorney, Agent, or Firm* — Fildes & Outland, P.C.

(57) ABSTRACT

The invention relates to a holster for keeping a pistol. The holster includes a grip guard and locking mechanism for the pistol, as well as a lifting mechanism to raise the pistol out of the grip guard in the release situation. The locking mechanism includes a catch and its release device.

10 Claims, 9 Drawing Sheets

HOLSTER FOR KEEPING A PISTOL

Figure 1:
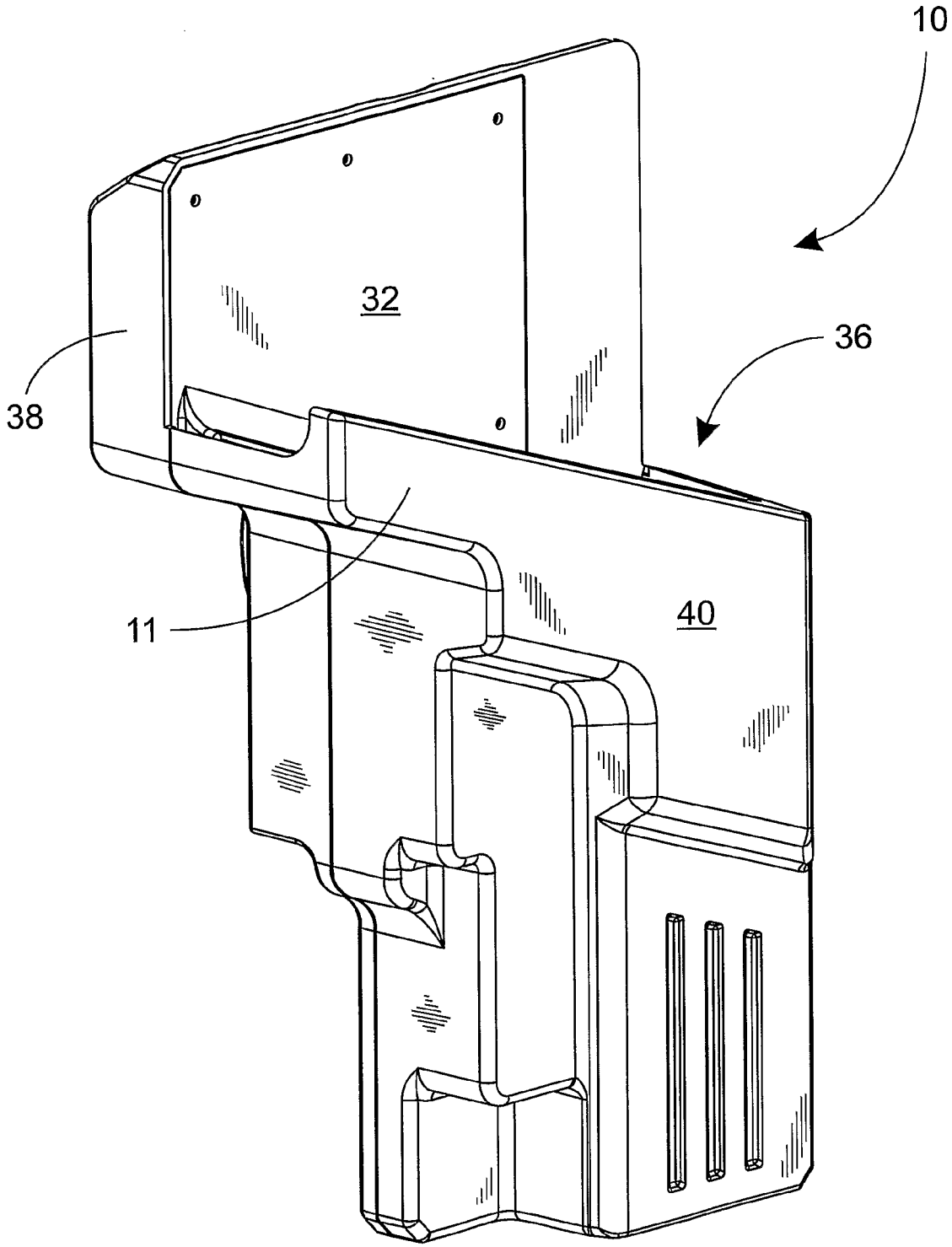

The present invention relates to a holster according to the preamble to claim 1. In general, the term pistol refers here to a handgun, in which there is an elongated barrel, a grip, and a trigger protected by a safety guard.

Many publications are known from the prior art, such as U.S. Pat. No. 5,944,239, U.S. Pat. No. 5,509,591, and U.S. Pat. No. 6,854,626, which disclose a holster that includes a locking mechanism for holding the pistol in place. There are various problems in the operation of the holders disclosed in the publications. For example, in the holster disclosed in publication U.S. Pat. No. 5,944,239, problems may appear when locking the pistol into the holster. In turn, in the holster disclosed in publication U.S. Pat. No. 5,509,591, in order to withdraw the pistol, a locking mechanism next to the second wall of the holster must be twisted, so that it can be very difficult to withdraw the pistol. In several holster models, the locking is based on friction, which abrades the surface treatment of the weapon.

In publication U.S. Pat. No. 6,854,626, the pistol is locked into the holster by means of a locking mechanism, from which the pistol is detached by using a lateral twist. Stated in general terms, the problem is, on the one hand, the removal of the pistol from the holster and, on the other, keeping the pistol in the holster and protecting it against attempted theft. To protect against theft of the pistol, holsters often have a special safety lock, which prevents the movement of the release catch. This cannot be regarded as sufficient, as the safety lock must be opened in certain cases of aggression and often remains open until the situation has been completely resolved. For example, during an arrest, an aggressive person may attempt to steal the weapon, even though the situation appears to have already calmed down.

In known holsters, release generally takes place using the forefinger or the middle finger, after which, in the next stage, it is necessary to grasp the grip of the weapon. However, U.S. Pat. No. 7,556,181 (Spielberger) discloses a holster, in which release takes place using the thumb, i.e. the operating button is at the side of the hip, but quite low down behind the grip of the weapon. A similar construction is used in the Ghost III holster manufactured by Ghost International S.r.l. (IT).

U.S. Pat. No. 6,738,891 (Loacklear III) discloses a holster equipped with a quick-release device, in which there is a trigger-guard catch mechanism operating from the side and a combined stabilization and quick-lift mechanism fitted against the barrel of the weapon. In this model, theft is a risk factor after the release of the safety catch, as the release button is on the outer side of the holster. The weapon will jump into the reach of the thief, if he can press the release button.

The invention is intended to create an improved holster for keeping a pistol, in which there is better security than before against attempted thefts, while nevertheless being easy to use. The present invention is characterized by

- the holster including a grip-guard covering at least the lower surface of the grip of the pistol placed in it, thus preventing fingers from being used to take hold around the grip, and
- lifting means being arranged to lift the pistol out of the safety guard, at least to such an extent as to allow the fingers to take hold around the grip, and
- a press-button being located in the upper part of the holster and next to the opening, on the belt-clip side.

Though it is not desired to give up the ease of use of the holster, the aforementioned combination is required to protect against the attempted theft described above. The grip-guard requires a special lifting element for the lifting distance needed to raise the grip sufficiently above the grip-guard. In addition to this, the press-button is on the belt-clip, i.e. the hip side, so that another person cannot easily press it. It is operated by the thumb, so that the grip rises straight into the thumb crook, i.e. between the thumb and forefinger, at the same time as the other fingers can immediately grasp the grip by curling one or more fingers sufficiently round the grip, or only by pressing the grip between the thumb and the fingers. Usually, the forefinger remains straight, ready to be placed inside the safety guard. In addition, it is important that the internal shape of the holster corresponds at least adequately to the shape of the pistol and that, during the lifting event, the piston slides along the internal surface to the gripping point.

Due to the grip-guard, the press-button must unavoidably be located substantially higher than the catch. The mechanism that changes the vertical movement of the press-button into the movement of the catch is generally in conjunction with the catch. Thus, an intermediate arm is naturally required to transfer the vertical movement to this mechanism. Preferably, a rotating catch is used, along with an angled part at the lower end of the intermediate arm, by means of which the direction of the movement is changed. A mechanism based on a rotating catch is the most reliable, as the mechanism must be operated with the aid of a long intermediate arm, i.e. the distance between the press-button and the catch is considerable.

When using a weapon equipped with a full clip, a lifting point acting on the safety guard will generally be in better balance than when lifting from the barrel.

In the holster according to the invention, the pistol will be certain to remain in place, but the user can easily remove the pistol when the need arises. In addition, the holster comprehensively protects the weapon.

The holster includes both a catch to direct a locking force onto the safety guard belonging to the pistol, as well as an intermediate arm to move the catch. Once the locking of the pistol is ensured by the catch, which is moved with the aid of the intermediate arm, the pistol is securely locked. However, using the combination of the intermediate arm and the catch, the pistol can be reliably released from the locking, when required.

Figure 2:
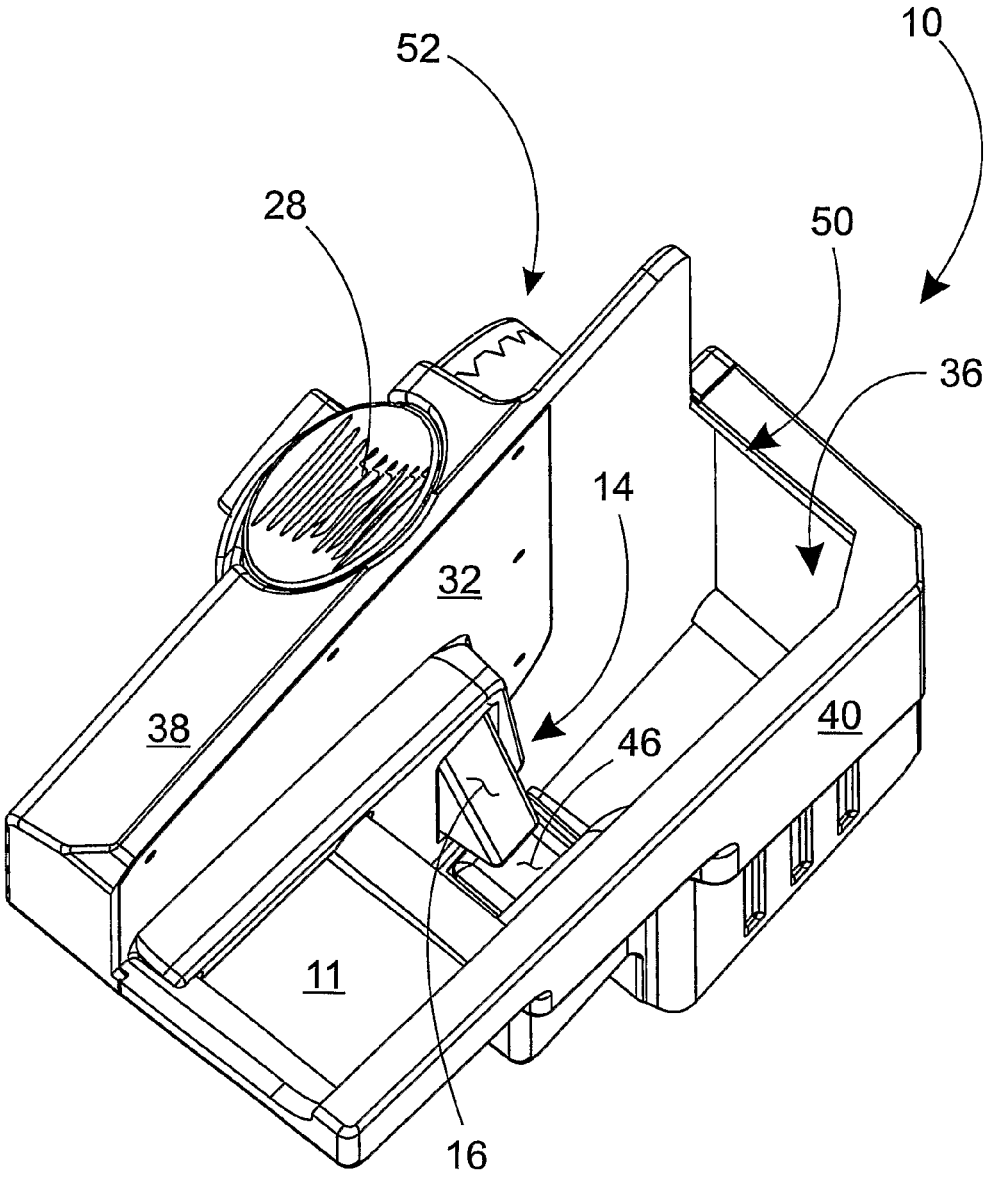
Figure 3:
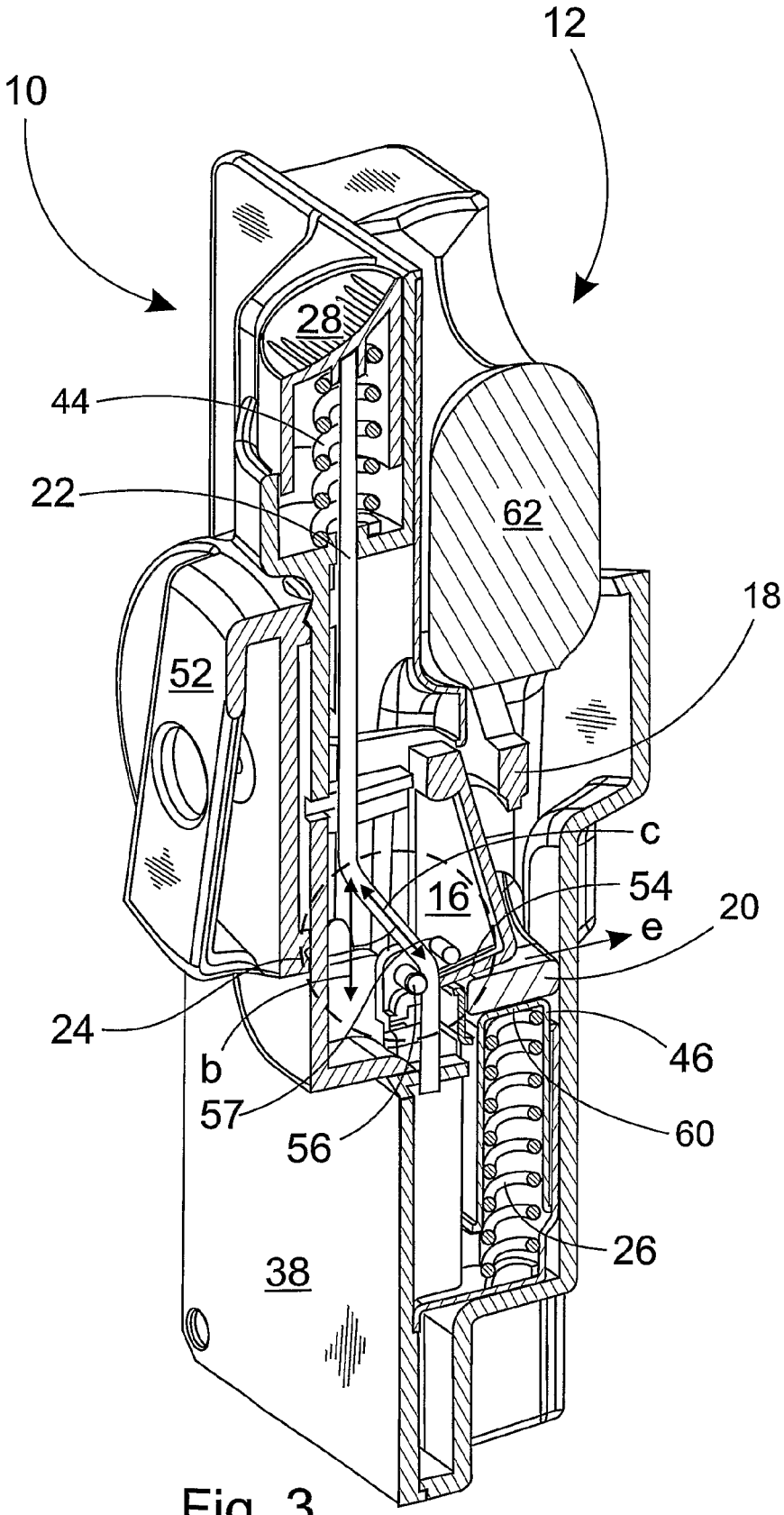
Figure 4:
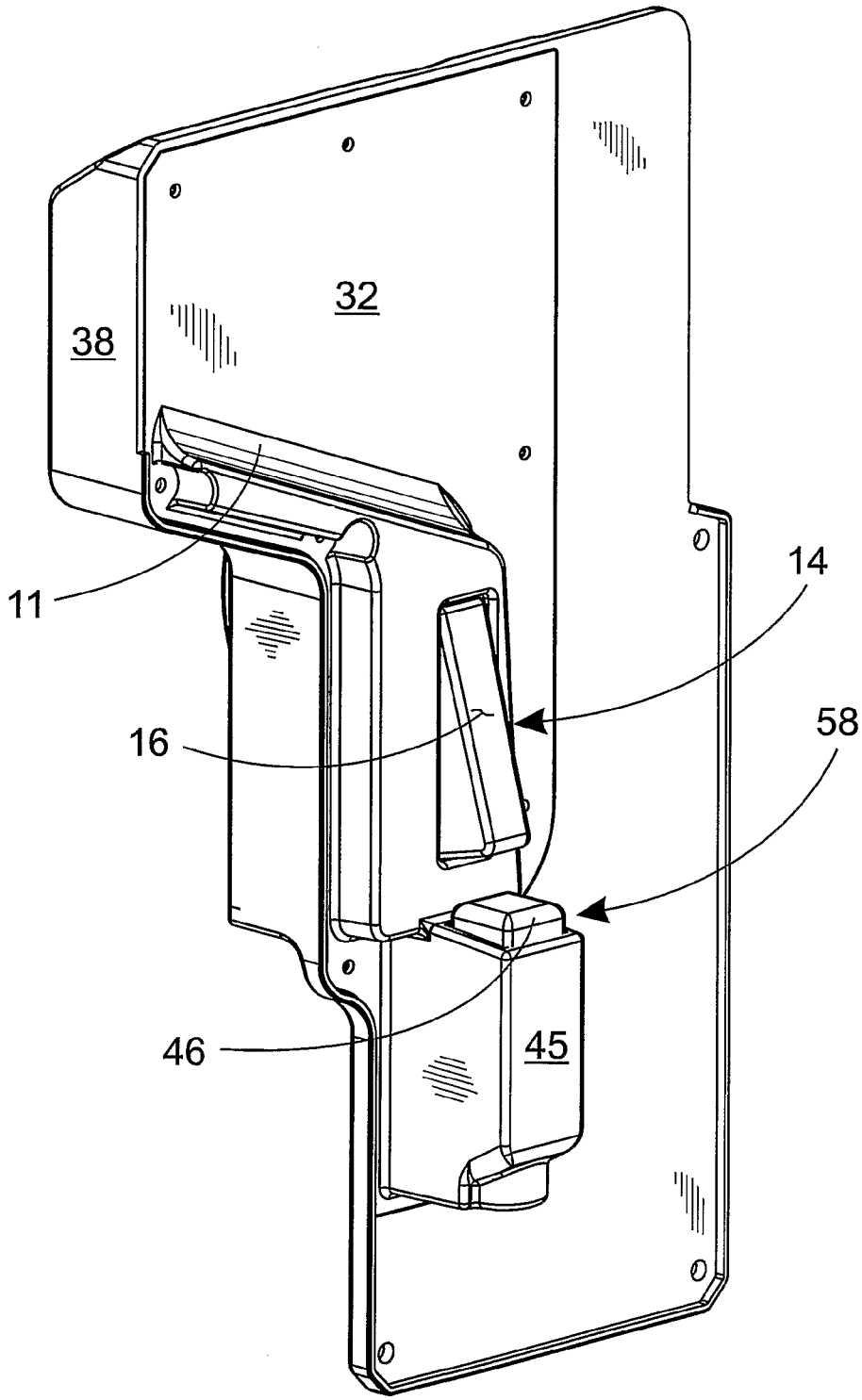
Figure 5:
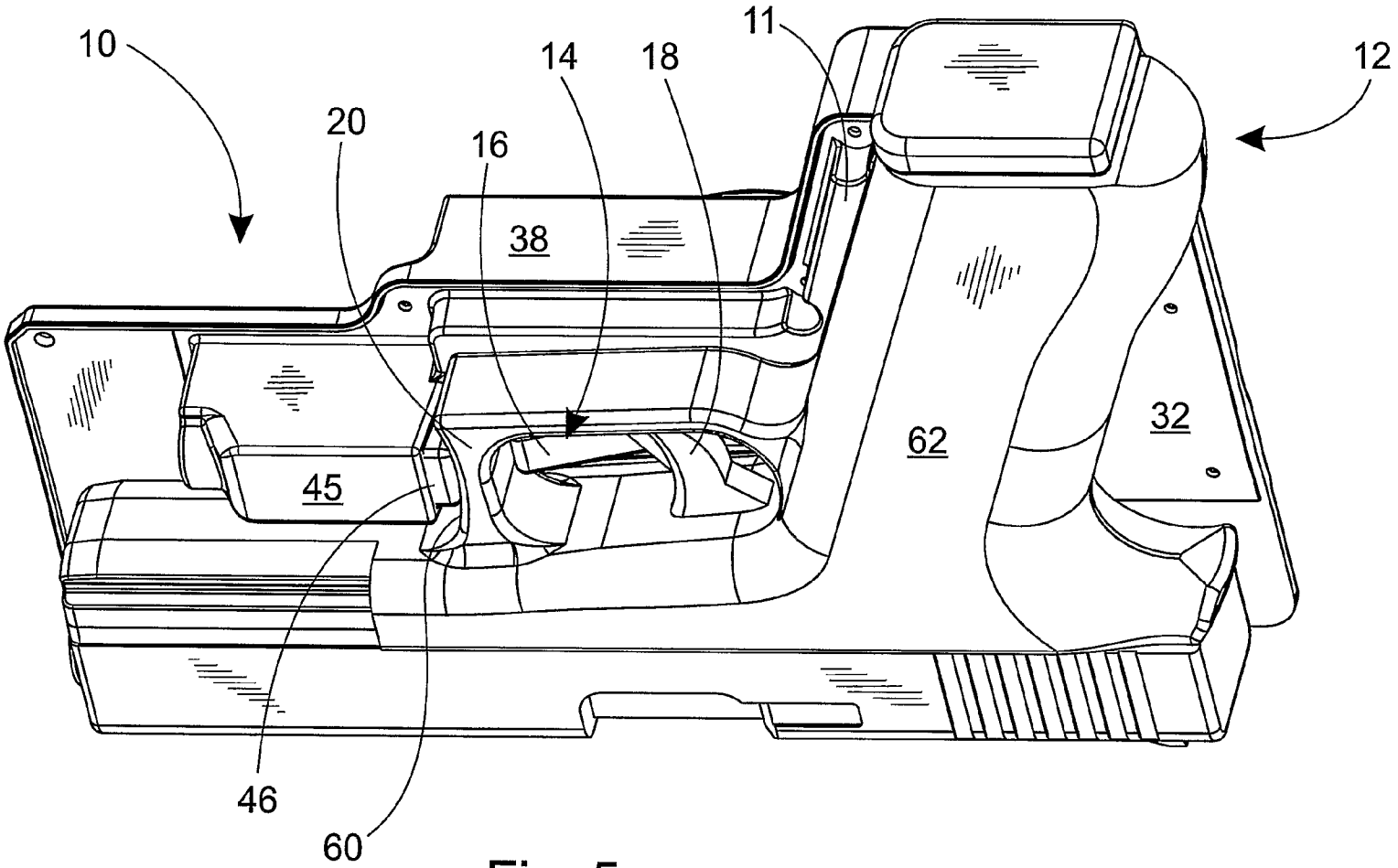
Figure 6:
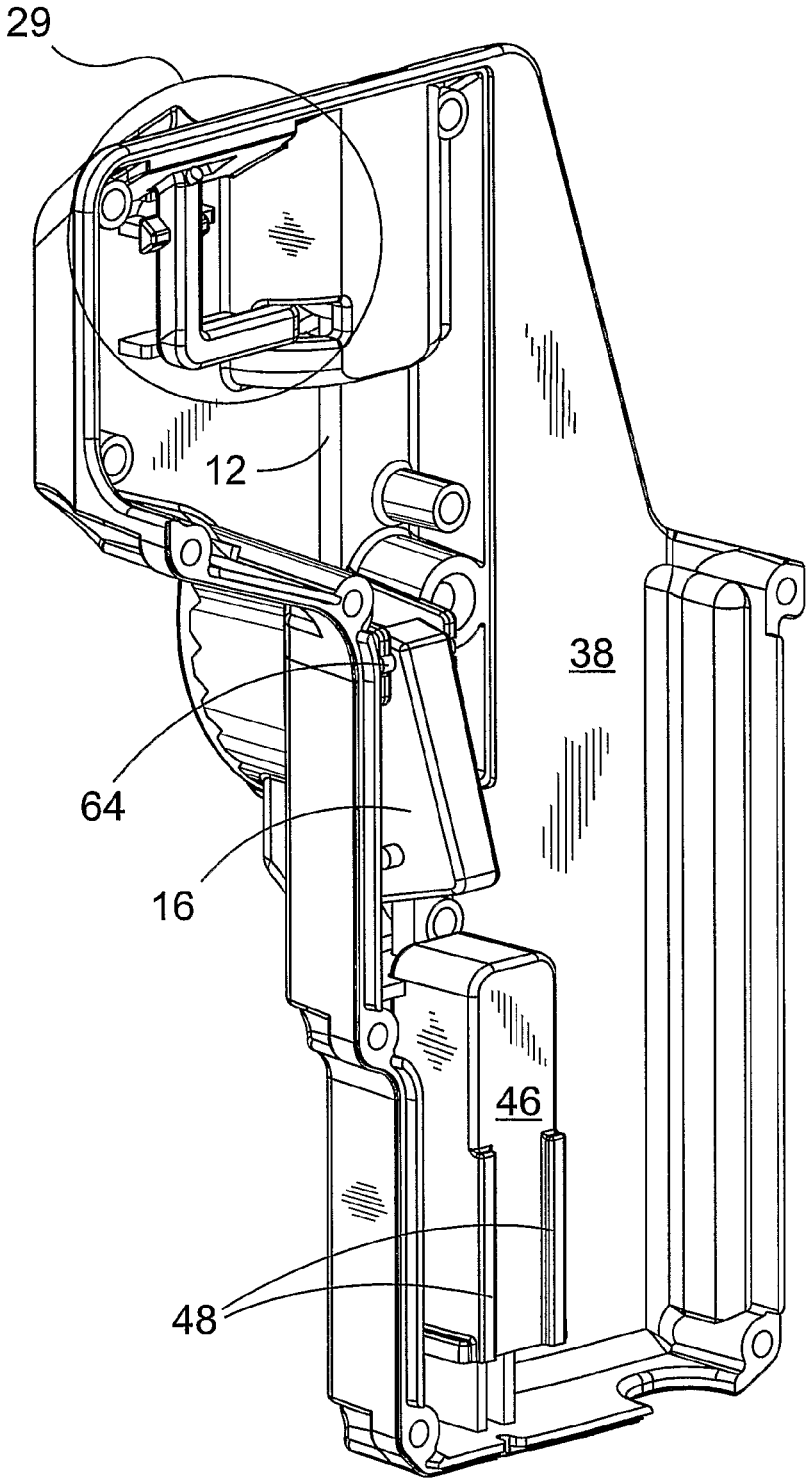
Figure 7:
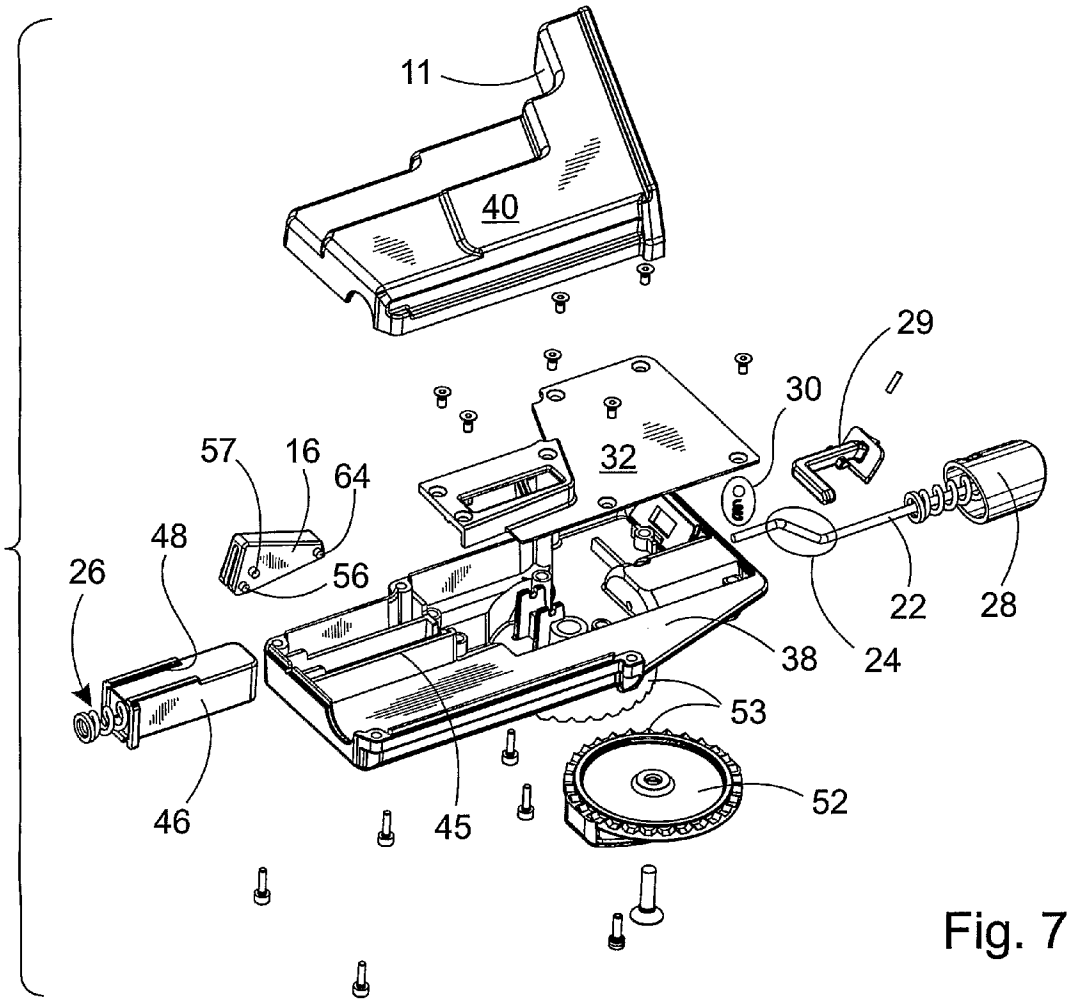
Figure 8:
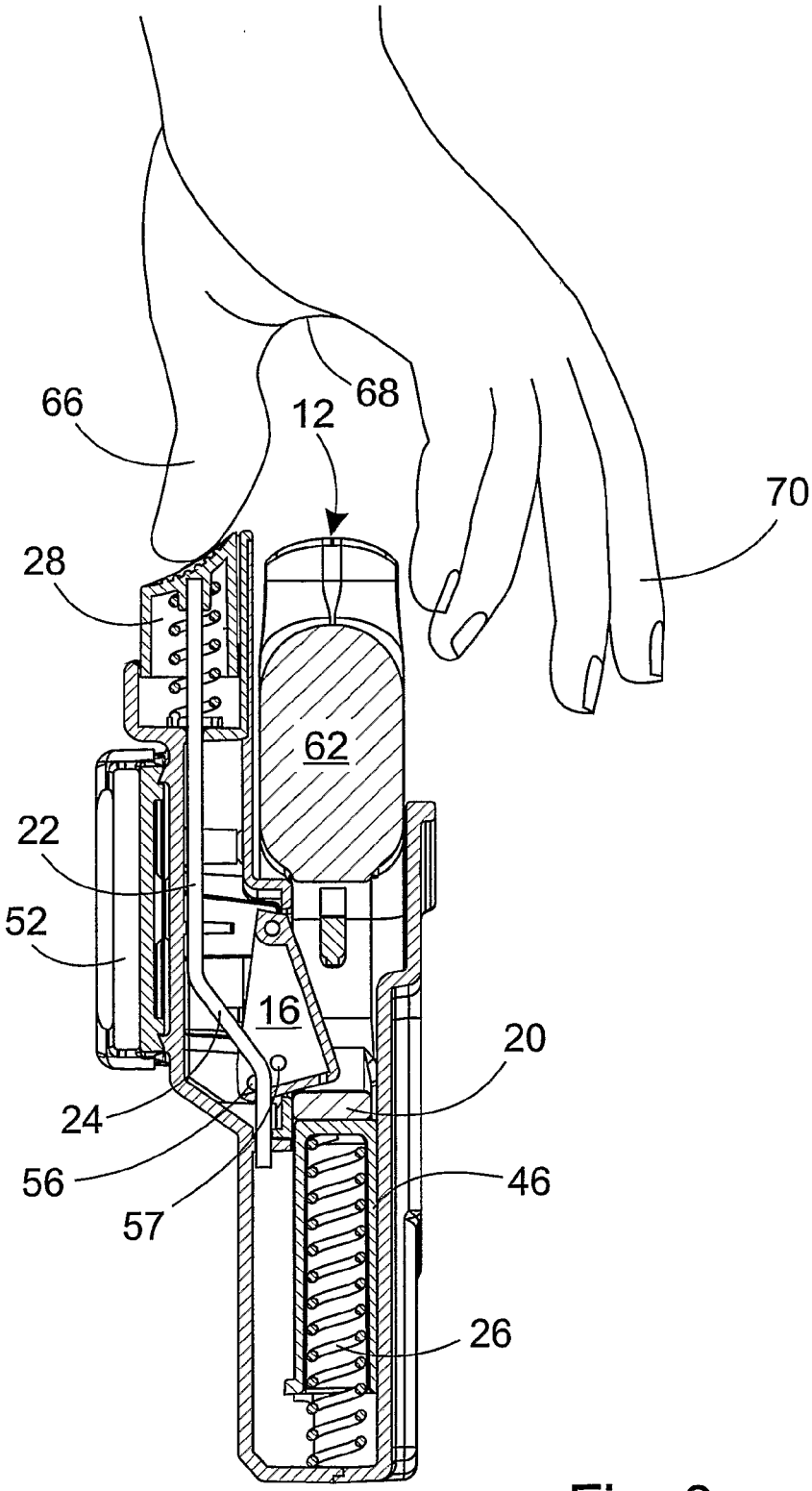
Figure 9:
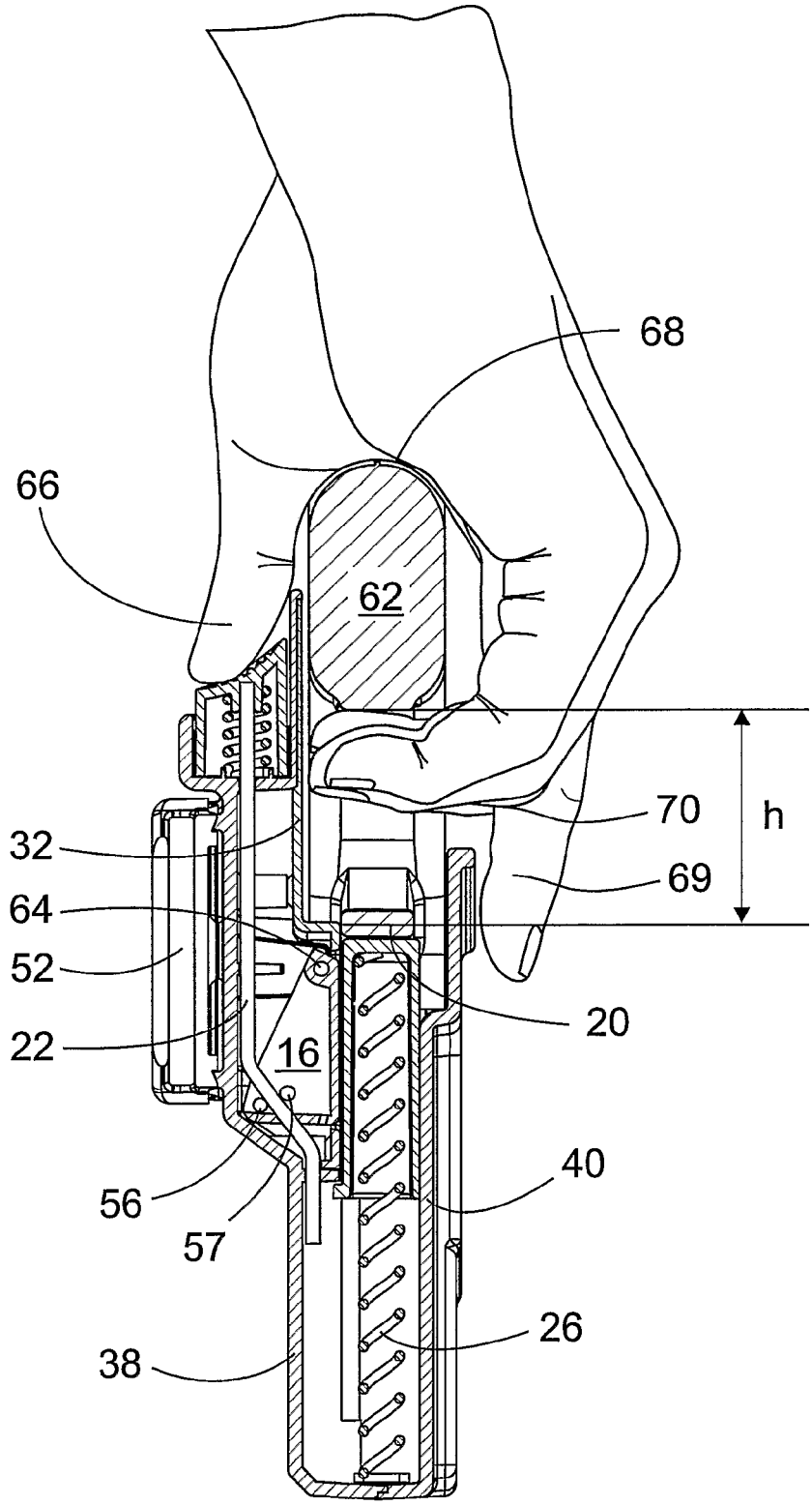

In the following, the invention is described in detail with reference to the accompanying drawings, showing some applications of the invention, in which FIG. 1 shows the holster according to the invention, without a pistol, seen from the pistol-recess side, FIG. 2 shows the holster according to the invention, without a pistol, seen from the pistol-recess side at an angle from above, FIG. 3 shows a vertical cross-section of the holster in the thickness direction, FIG. 4 shows the locking mechanism and lifting mechanism belonging to the holster, seen from an angle from the side, with the mechanism casing in place and the outer casing removed, FIG. 5 shows the situation in FIG. 4, with a weapon locked in place, FIG. 6 shows a variation of the holster in the situation of FIG. 4, with the mechanism casing removed, FIG. 7 shows an exploded view of the holster of FIG. 6, and FIGS. 8 and 9 show the operation of an improved holster model with the aid of cross-sectional views, before and after pressing the press-button.

FIG. 1 shows the holster 10 according to the invention, without a pistol 12, seen from the pistol-recess 36 side. FIG. 2 shows the holster 10 according to the invention, without a pistol 12, seen from an angle from above. The recess 36, which conforms to the shape of the weapon, is clearly visible from the viewing angle in question and has an opening 50 at its upper end, for inserting the pistol into it barrel first. The holster 10 includes a pistol's 12 locking mechanism 14, in which the central component is a catch 16 that rotates in front of the pistol's safety guard 20, to direct a locking force onto it when the pistol 12 is in place (FIG. 5). More specifically, the locking force is directed onto the inner surface of the safety guard.

The holster 10 shown in FIG. 2 includes a spring-loaded ram 46 for raising the pistol 12 towards the pistol opening 50 once the catch 16 has rotated away from in front of it, FIG. 9. The lifting spring can raise the pistol when the pistol is released from the pressure of the locking mechanism, more specifically, from the pressure of the catch. The pistol rises to a suitable point, at which the user can easily lift it out of the holster. When the spring raises the pistol to the gripping position shown, the distance between the holster and the pistol should be such that the pistol can be gripped easily. Once the lifting spring has raised the pistol, the catch will not lock the pistol into the holding position, unless the user pushes the pistol into the holding position.

The holster 10 shown in FIG. 2 includes not only the actual holster, but also a belt clip 52, for carrying it, and the said catch mechanism. The holster is mainly formed of three rigid casings, which are the rear casing 38 against the hip, the front casing 40, and the mechanism casing 32. The totality of the holster 10 is delimited by the outer shell formed by the rear casing 38 and the front casing 40. The mechanism casing 32 and the rear casing 38 delimit the locking mechanism between them, to the extent that it need not be outside them. The catch 16 can rotate from a special opening in the mechanism casing 32 into the recess 36.

The press-button 28, which is used to release the locking of the pistol, is mostly in the upper surface of the rear casing 38 and can be pressed inwards. By pressing the press-button, the pistol rises from the holster by, for example, 40-65 mm, more specifically 50-55 mm. Such a rise allows a good grip, as the grip of the weapon rises into the crook of the thumb. FIG. 2 shows clearly that the press-button 28 and the catch 16 are on the same transverse line. This also means that, in the release situation, the thumb and forefinger adopt a position on this line, which corresponds to the position of the trigger guard, at the same time as the fingers adopt a position behind the trigger guard on the lower part of the grip.

FIG. 3 shows a vertical cross-section of the holster 10 and pistol 12 in the thickness direction. The view is at an angle from the rear, so that the press-button 28 and belt clip 52 belonging to the holster 10 can be seen in the figure.

The locking mechanism 14 includes both a catch 16 to direct a locking force onto the pistol and an intermediate arm 22 to rotate the catch 16. The catch forms a sector of 30°-50°. The angle between the average direction of movement of the rotation of the catch 16 and the direction of movement b of the intermediate arm 22 is 70°-110°, preferably 80°-105°. Thus, the press-button that moves the intermediate arm, and the intermediate arm are pressed essentially towards the pistol when lifting the pistol out of the holster.

By pressing the press-button, the pistol is released, as described above. If it is desired to ensure that only the user can remove the weapon, a press-button lock can be fitted to the holster on the belt-clip side. The press-button lock is located in an even more protected manner than the press-button, so that no-one but the user can access it. Because the location of the press-button itself is very well protected, the press-button lock is typically unnecessary. One press-button lock is shown in the embodiment according to FIGS. 6-9.

In the holster 10 shown in FIG. 3, between the catch 16 and the intermediate arm 22, there is a wedge structure 24 that transmits the movement of the intermediate arm 22, in order to rotate the catch 16. The wedge structure is a reliable mechanism construction for converting the movement of the intermediate arm into the rotation of the catch. More specifically, by means of the wedge structure, the vertical movement of the intermediate arm is transformed into the transverse movement of the catch, as the total rotation is quite limited. The wedge structure 24 is preferably in the intermediate arm 22. With the wedge structure being in the intermediate arm, the total solution can be easily implemented, as the wedge structure can be easily formed in the intermediate arm of the press-button. The intermediate arm 22 is supported on a few points in the rear casing 38, supported on which it can move in the direction of movement b of the intermediate arm, which is parallel to the vertical direction. The catch 16 too is supported on the rear casing 38. The support of the catch is implemented by means of a pin, which permits the catch to rotate around its axis. When the catch 16 rotates, the lower edge 54 of the catch 16 moves mainly in the direction e. The catch 16 includes a slider pin 56 and a guide pin 57, which are in contact with wedge structure 24 of the intermediate arm 22.

In the holster 10 shown in FIG. 3, the intermediate arm 22 has the direction of movement b and the wedge structure 24 the direction c. The angle between the direction b and the direction c of the wedge structure 24 is 10°-50°, preferably 20°-30°. Thus, in order to release the pistol from the holster, the required movement of the intermediate arm 22 in the direction of movement b is 5-20 mm, preferably 8-13 mm.

The holster 10 shown in FIG. 3 includes a lifting spring 26 with a ram 46 for raising the pistol 12, when the pistol 12 is released from the pressure of the catch 16.

FIG. 4 shows the visible parts of the locking mechanism 14 and the lifting mechanism 58, when the mechanism casing 32 is in place in conjunction with the rear casing 38. Part of the catch 16 of the locking mechanism 14 can be seen. For its part, part of the ram 46 of the lifting mechanism 58 can be seen in the slide casing 45.

The locking mechanism 14 includes the catch 16 and the intermediate arm 22. For its part, the lifting mechanism includes a lifting spring 26 and the ram 46 of the lifting spring 26, FIG. 6.

The lifting spring 26 directs a force on the safety guard 20 of the trigger 18 by means of the ram 46 of the lifting spring. More specifically, the lifting force is direction to the outer surface 60 of the safety guard 20.

FIG. 5 shows an axonometric view of the holster 10 without the front casing, the pistol 12 being locked in the holster 10 by the locking mechanism 14. The pistol in the figure is a Glock-17. Each model of weapon generally requires its own shape components. Some models of weapon can be fitted into a generic basic model by means of suitable additional shape components.

The rear casing 38, the front casing 40, and the mechanism casing 32 are preferably manufactured by moulding, for example, from fibre-reinforced epoxy, thus making the holster light in weight.

FIGS. 6-9 show a holster model that is slightly modified from the previous one. The same reference numbers are applied to components that are functionally similar to those above. FIG. 6 corresponds mainly to FIG. 4, but the mechanism casing has been removed. Thus, in this model, the press-button safety lock 29, in which the end of the pin is pushed in front of the press-button when the safety lock is set, is clearly visible. However, the height of the ram 46, i.e. also the length of the lifting spring, has been increased considerably, to prevent the fatiguing of the spring due to the length of movement. In addition, there are guides 48 in the outer surface of the ram 46 against the front casing, which correspond to grooves in the internal surface of the front casing, in which there are also walls corresponding functionally to the slide case 45 (FIG. 7).

The exploded view in FIG. 7 shows clearly that the principal components of the holster are the rear casing 38, the mechanism casing 32, the front casing 40, and the catch mechanism and ram 46. The catch mechanism includes the catch 16, the intermediate arm 22, the press-button 28, as well as its safety lock 29. The spring-ball pair 30 installed in a recess in the rear casing creates clear on/off positions (not shown) for the safety lock 29.

The belt clip 52 includes toothed adjustment plates for setting the holster to the desired angle relative to the belt.

The principal components of the holster are attached to each other by screws, which permits, the mechanism to be serviced and tuned afterwards. For example, the lifting height can be altered by changing the lifting spring 26.

FIGS. 8 and 9 show the release of the pistol in detail. The holster 10 is attached to the user's belt and located at the side of their hip. In FIG. 8 the hand is approaching the holster in the correct position to remove the pistol 12 from it. On the other hand, it can easily be concluded from FIG. 8, particularly in conjunction with FIG. 5, that someone other than the user of the weapon will not have effective access to the grip 62 of the pistol, but would instead also grasp the grip guard 11 and thus the entire holster 10 and would not be able to remove the pistol 12 from it, even by using great force.

In the correct position, the thumb 66 of the user's hand depresses the press-button 26 at the same time as the other fingers, particularly the middle finger 70 adopt a position on the other side of the grip 62, with the crook 68 of the thumb remaining straight above the grip.

When the user then uses their thumb 66 to depress the press-button 28, this releases the catch 16 from in front of the safety guard 20, allowing the ram 46 to push the pistol upwards by the force of the lifting spring 26 while the grip 62 moves straight into the crook 68 of the thumb. The grip 62 can then either be grasped between the thumb 62 and the fingers, or some of the fingers can already be wrapped around the grip 62. The forefinger 69 is still kept straight. In any event, the pistol can be easily pulled out and made quickly and reliably ready for use.

Alternatively, the lifting spring can be located above the slide in holsters for handguns to which some accessory has been fitted in front of the trigger guard. This accessory can be a laser sight or a light. The spring will then operate inversely, (tension spring), in which case it will raise the weapon out of the holster with the aid of an intermediate piece.

The invention claimed is:

1. Holster for receiving a pistol having a grip, a barrel, a trigger, and a trigger's safety guard, which holster includes a rigid case that surrounds at least the barrel and the safety guard, in the upper part of which there is an opening for inserting the pistol into the case barrel first, and a belt clip for carrying on the user's belt, at the side of the user's hip, and a locking mechanism integrated with the holster for locking the pistol into the holster, in which the locking mechanism further includes a catch, which moves essentially transversely, for holding the safety guard, and a quick-release means, comprising a press-button on the outer surface of the holster, and lifting means operated by a lifting spring, for raising the pistol from the holster, wherein—the holster includes at least a grip guard covering the lower surface of the grip of the pistol placed in the holster, thus preventing the use of the fingers from taking hold around the grip, and the holster further includes an intermediate arm between the catch and the press button, the press button being located in proximity with the grip guard, the lifting spring directs force on the trigger's safety guard, the lifting means are arranged to raise the pistol to at least such an extent that use of fingers to grasp the grip is enabled, and the press-button is located in the upper part of the holster and next to the opening, on the side next to the belt clip, the locking mechanism catch is releasable by the inward vertical movement of the press-button.

2. Holster according to claim 1, characterized in that the lifting means are arranged to raise the grip of the pistol into the crook of the thumb.

3. Holster according to claim 1, characterized in that the lifting means are arranged to raise the pistol by the trigger's safety guard.

4. Holster according to claim 3, characterized in that the quick-release means of the catch comprise the intermediate arm between the press-button and the catch, and in which intermediate arm there is a wedge structure arranged to operate jointly with the catch, to convert the vertical movement of the intermediate arm into the principally transverse movement of the catch.

5. Holster according to claim 4, characterized in that the catch is arranged to rotate around its axis and form a 25°-50° sector.

6. Holster according to claim 4, characterized in that the movement of the intermediate arm is 5-20 mm.

7. Holster according to claim 6, characterized in that the angle between the direction of the lever arm and the direction of the wedge structure is 130'-170'.

8. Holster according to claim 1, characterized in that the holster includes the actual holster and the belt clip supporting it, in which the holster is formed of rigid casing components.

9. Holster according to claim 8, characterized in that the casing components of the holster are arranged to conform precisely to the shapes of the pistol.

10. Holster according to claim 1, characterized in that the press-button and the catch are on the same transverse line, which corresponds to the location of the safety guard, so that in the release situation the user's thumb and forefinger are arranged to take up a position on this line.

* * * * *